US006453657B1

(12) United States Patent
Teravainen

(10) Patent No.: US 6,453,657 B1
(45) Date of Patent: Sep. 24, 2002

(54) HYDRAULIC DEVICE FOR ASSEMBLY AND DISASSEMBLY OF CONVEYOR CHAINS USING INTERFERENCE-FIT CONNECTING PINS AND METHOD OF USING THE SAME

(75) Inventor: Anthony Allan Teravainen, Santee, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/515,671

(22) Filed: Feb. 29, 2000

(51) Int. Cl.[7] ..... B21L 21/00
(52) U.S. Cl. ..... 59/7; 59/11; 29/243.53
(58) Field of Search ..... 59/7, 11; 29/243.53, 29/243.54

(56) References Cited

U.S. PATENT DOCUMENTS 2,387,551 A * 10/1945 Abramson et al. ..... 59/7
3,553,960 A * 1/1971 Ellefson ..... 59/7
4,063,412 A * 12/1977 Bruzek ..... 59/7
4,506,501 A * 3/1985 De Vall et al. ..... 59/7
4,870,739 A * 10/1989 Richards ..... 29/252
5,463,862 A * 11/1995 Reisenauer ..... 59/7

FOREIGN PATENT DOCUMENTS

SU 654343 * 12/1977 ..... 59/7

* cited by examiner

*Primary Examiner*—David Jones
(74) *Attorney, Agent, or Firm*—Rader, Fishman & Grauer PLLC; Ronald P. Kananen, Esq.

(57) ABSTRACT

A portable hydraulic press with two opposing plates connected by bolts can be clamped on a conveyor chain that has interference-fit connecting pins between pairs of rectangular plates forming the chain links to assemble or disassemble the chain. Once the press is clamped in place, a hydraulic cylinder of the press is then actuated to force the connecting pin in or out of the chain. If the pin is being pushed out, it passes through a hole in a back plate of the press in order to disassemble or break the chain.

21 Claims, 6 Drawing Sheets

HYDRAULIC DEVICE FOR ASSEMBLY AND DISASSEMBLY OF CONVEYOR CHAINS USING INTERFERENCE-FIT CONNECTING PINS AND METHOD OF USING THE SAME

FIELD OF THE INVENTION

The present invention relates to the field of chains used in conveyors for industrial processes such as ovens for sealing the frit glass of cathode ray tubes. More specifically, the present invention relates to a device and method for separating the links of such chains when necessary for repair or maintenance. The present invention also relates to a device and method for reassembling the links of such chains.

BACKGROUND OF THE INVENTION

Many industrial processes require the movement of articles along an assembly line. Additionally, some industrial processes require the movement of articles through a processing device, such as an oven, inspection station or washing machine. A specific example of such a process is the manufacturing of cathode ray tubes. Cathode ray tubes are typically used to construct televisions and computer monitors.

In cathode ray tube manufacture, a relatively flat portion of the tube, i.e., the face portion where images are displayed, is attached to a funnel and neck portion that extends away from the face. Frit glass is used to create the seal between the face portion and the funnel portion of the cathode ray tube. After the frit is applied, the assembly is baked in an oven to solidify the frit glass and create the seal between the face and funnel portions of the cathode ray tube.

In conventional cathode ray tube manufacturing, a conveyor consisting of driven chains is used to transport the tubes through a frit sealing oven. The chains are designed to be extremely strong and capable of withstanding the drastic variations in temperature experienced passing into and through the frit sealing oven. Such a chain drive system is being incorporated into the majority of new frit sealing oven designs.

FIG. 1 includes a top and side view of a typical chain used in such industrial processes as cathode ray tube frit sealing ovens. As shown in FIG. 1, the links of the chain (100) are made by rectangular metal plates (101) which are connected by interference-fit connecting pins (102). Two plates (101), an upper plate (101A) and a lower plate (101B), run between each pair of adjacent pins (102A, 102B) to form a link in the chain (100).

The distance between the upper and lower plates (101) alternates with every other link of the chain (100) as shown in FIG. 1. Each pin (102) passes through four plates (101), thereby securing an inner (101C) and outer (101A, 1010B) pair of plates (101). These inner and outer plate pairs correspond to different links in the chain (100) as shown in FIG. 1.

Each connecting pin (102) also passes through a roller (103)that rotates freely about the pin (102) and maintains the separation between the plates (101) attached to that pin (102). A side view of the chain (100A) shows that the rollers (103) extend below the plates (101) to allow the chain to roll. This effect is achieved by shift the holes in the plates (101), through which the pin (102) passes, downward from the center line of the plate (101).

Shifting the rollers (103) downward to extend below the chain (101) also leaves a relatively flat upper surface of the chain (101). This surface is well-suited for transporting product fixtures such as cathode ray tube assemblies.

The connecting pins (102) are interference-fit through holes in the plates (101). The interference-fit is, for example, a 10-ton press. This is necessary in order to hold the chain together under the extreme temperature variations and load that the chain is subjected to. The conventional method of assembling the chain (100) is to drive the pins (102) through the chain plates (101) with a sledgehammer. For added security, a cotter pin (104) is then inserted through a hole in the end of each pin (102).

While these conveyor chains (100) are extremely strong and capable of standing up to the extreme conditions of industrial processes, the strength of the chains (100) also poses problems. For example, portions of the chain are subject to wear, for example, the rollers (103). However, when the chain becomes worn and needs to be replaced or requires maintenance, there is no way to disassemble or break the chain (100).

The use of conveyor chains (100) using interference-fit pins (102) in industrial processes is relatively new. Consequently, the manufacturers of these conveyor chains provide no method or device breaking or disassemble the chain (100) when necessary to replace or repair it. Moreover, once the chain (100) is installed there is typically very little space available to physically work on the chain (100). This prevents any large device from being used to separate the links of the chain (100). Additionally, the offset roller (103) and pin (102) preclude the use of a symmetrical-style press, for example, in disassembling the chain (100).

Consequently, there is a need in the art for a device and method for disassembling a conveyor chain which is linked with interference-fit pins so that the chain can be replaced or serviced. There is a further need in the art for a device and method of assembling or re-assembling such a chain.

SUMMARY OF THE INVENTION

It is an object of the present invention to meet the above-described needs and others. Specifically, it is an object of the present invention to provide a device and method for disassembling a conveyor chain that is linked with interference-fit pins so that the chain can be replaced or serviced. It is a further object of the present invention to provide a device and method of assembling or re-assembling such a chain.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve these stated and other objects, the present invention may be embodied and described as a hydraulic press for disassembling a conveyor chain that has interference-fit connecting pins between chain links. The press includes a hydraulic unit with a hydraulic head; and a structure for clamping the hydraulic unit to the conveyor chain such that the hydraulic head, when actuated, forces one of the interference-fit connecting pins at least partially out of the conveyor chain to disassemble the conveyor chain.

The clamping structure preferably includes aback plate; a cylinder plate on which the hydraulic unit is mounted; and a number of bolts connecting the back plate to the cylinder plate. This structure is clamped to the conveyor chain by tightening the bolts between the back plate and the cylinder plate when the chain is disposed between the back plate and the cylinder plate.

The press also preferably includes a spacer plate that is in contact with both the back plate and an inner plate of a first chain link of the conveyor chain. The spacer plate allows the back plate to rest evenly on an outer plate of a second chain link adjacent the first chain link and the spacer plate.

In order to disassemble the chain, the back plate may have a hole through which the connecting pin passes when forced from the chain by the hydraulic head. Preferably, this hole is offset from a center of the back plate to account for a corresponding offset of the connecting pin from the centerline of the chain.

The present invention also encompasses the method of using the press described above. Specifically, the present invention encompasses a method of disassembling a conveyor chain with interference-fit connecting pins between chain links by clamping a portable hydraulic unit with a hydraulic head to the conveyor chain such that the hydraulic head, when actuated, forces one of the interference-fit connecting pins at least partially out of the conveyor chain to disassemble the conveyor chain.

The present invention also encompasses the method of suing the press described above to assemble or reassemble the chain. Specifically, the present invention encompasses a method of assembling a conveyor chain with interference-fit connecting pins between chain links by clamping a portable hydraulic unit with a hydraulic head to the conveyor chain such that the hydraulic head, when actuated, forces one of the interference-fit connecting pins into the chain to assemble the chain.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Using the drawings, the preferred embodiments of the present invention will now be explained.

Figure 1:
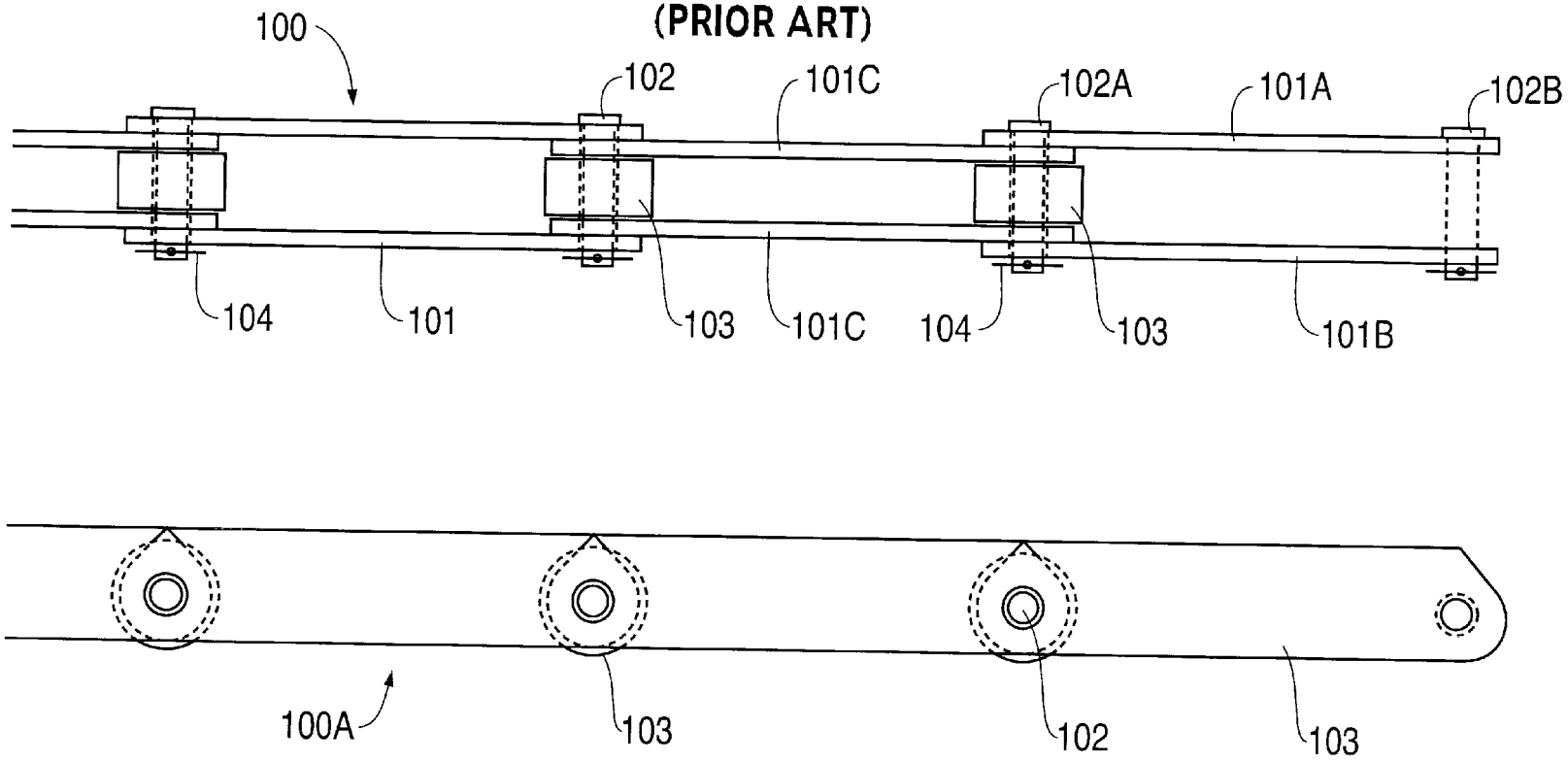
FIG. 1 (PRIOR ART)
FIG. 1 is a top and side views of a conventional conveyor chain with interference-fit pins connecting the chain links.
Figure 2:
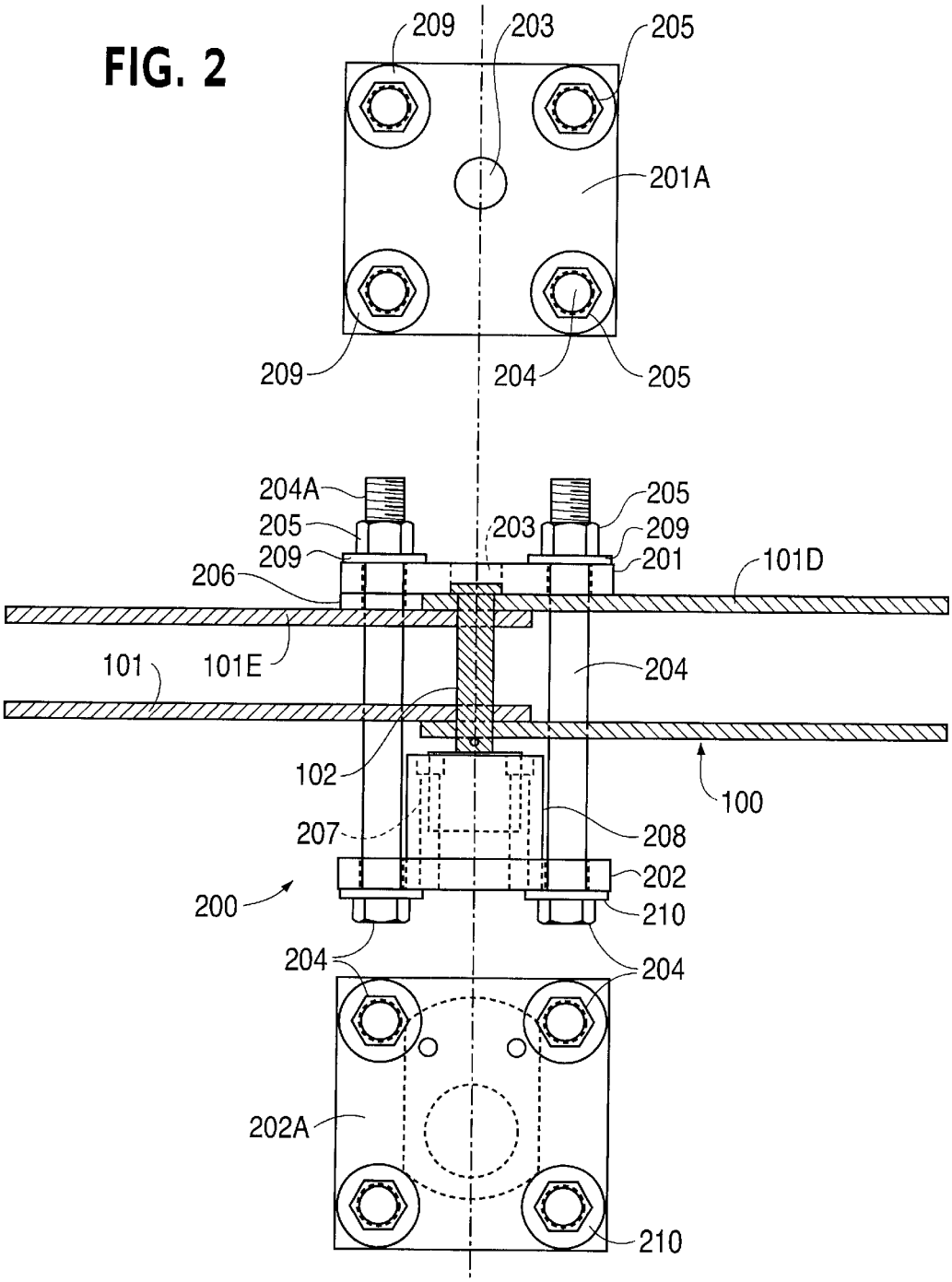
FIG. 2 is an illustration of a hydraulic press according to the present invention for disassembling a conveyor chain with interference-fit pins connecting the chain links.

As shown in FIG. 2, the present invention includes a hydraulic press (200) for disassembling a conveyor chain that has links connected with interference-fit connecting pins. As shown in FIG. 2, a portion of the conveyor chain (100) is placed in the press (200) so that the cylinder of the press can be used to force the interference-fit connecting pin (102) out of the chain (100).

The hydraulic press (200) of the present invention include a cylinder plate (202) and a back plate (201) The cylinder plate (202) and back plate (201) are preferably square or rectangular plates that are connected, preferably, by four bolts (204) secured through respective holes in the four corners of both the cylinder (202) and back (201) plates.

Figure 4:
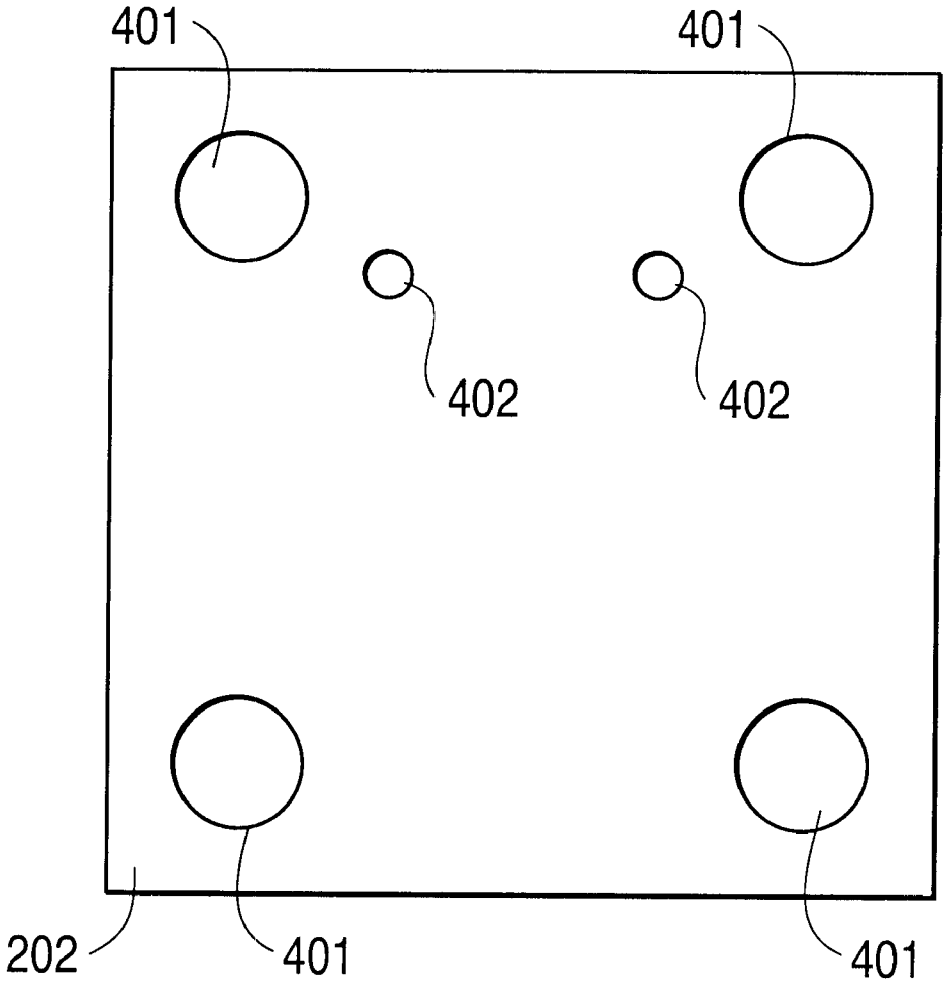
FIG. 4 is an illustration of a cylinder plate of the press of FIG. 2.

The head of each bolt (204) preferably abuts a flat washer (210). The bolt (204) passes through the washer (210) and through a hole (401; FIG. 4) in the cylinder plate (202). A top view of the cylinder plate (202A) is provided in FIG. 2. The top view of the cylinder plate (202A) shows the location of the four bolts (Z04) and washers (210) in the four corners of the plate (202A).

Figure 5:
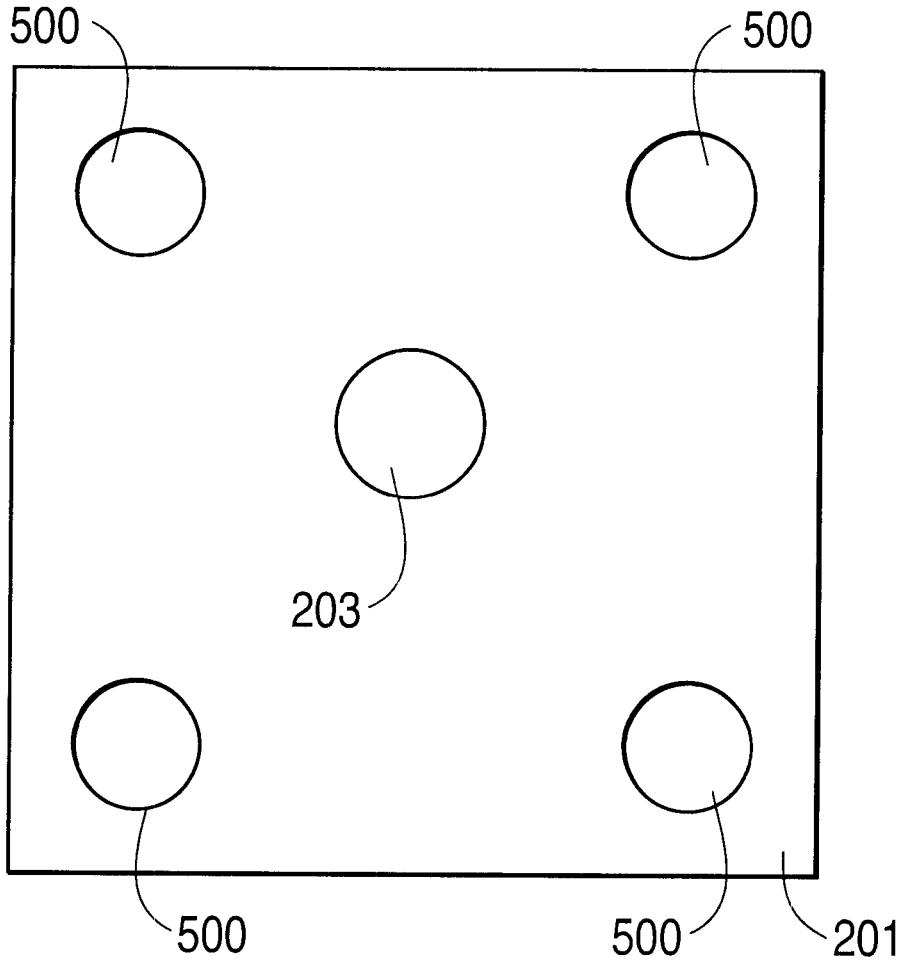
FIG. 5 is an illustration of a back plate of the press of FIG. 2.

The opposite end of each bolt (204) is threaded (204A) and passes through a hole (500; FIG. 5) in the back plate (201). A flat washer (209) is preferably placed on the threaded end (204A) of each bolt (204). A nut (205) is then screwed onto the threaded end (204A) of each bolt (204) and abuts the washer (209) while holding the back plate (201) on the bolts (204).

A top view of the back plate (201A) is also provided in FIG. 2. The top view of the back plate (201A) shows the location of the four threaded ends of the bolts (204) that extend through the back plate (201A). The washers (209) and nuts (205) secured on each of the four bolts (204) are also shown in the top view (201A).

A hydraulic cylinder (208) is secured on the cylinder plate (202). Screws with lockwashers (207) are preferably used to secure the hydraulic cylinder (208) to the cylinder plate (202).

Figure 3:
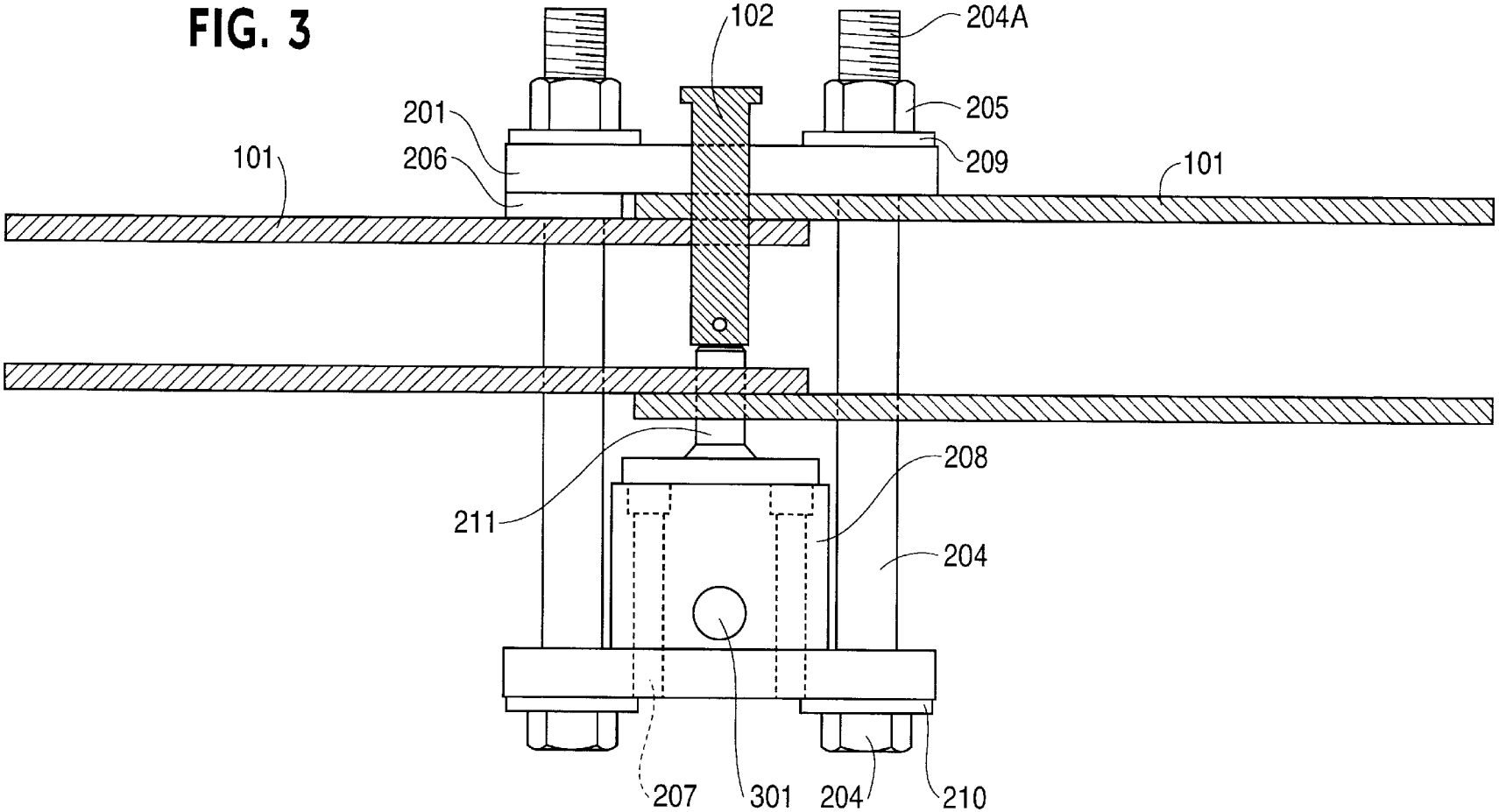
FIG. 3 is an illustration of the hydraulic preps of FIG. 2 in which the hydraulic cylinder has been actuated to remove an connecting pin.

As shown in FIG. 2, when it become necessary to disassemble the chain (100), a portion of the chain (100) including an interference-fit connecting pin (102) is placed in the press (200). The pin (102) is aligned with the cylinder of the hydraulic unit (208). Consequently, as shown in FIG. 3, when the hydraulic unit (208) is actuated, the cylinder or head (211) extends forcing the interference-fit connecting pin (102) out of the chain.

Referencing FIG. 2, the back plate (201) includes a hole (203) through which the connecting pin (102) passes when forced out of the chain (100) by the cylinder or head (211) of the hydraulic unit (208). As shown in FIG. 3, the hydraulic unit (208) include a, port (301) to which a hydraulic line (not shown) is connected to the hydraulic unit (208). Pressurized hydraulic fluid is provided through the hydraulic line and port (301) to drive the cylinder or head (211) as shown in FIG. 3.

FIG. 4 illustrates a preferred embodiment of the cylinder plate (202) of the present invention. As shown in FIG. 4, the cylinder plate (202) is square and measures 4.375 inches to a side. The plate (202) includes six holes. Four are located at the corners of the plate (202) and, as explained above, receive the four bolts (204) that connect the cylinder plate (202) to the back plate (201). In the preferred embodiment, these four holes (401) are centered 1.5 inches from a line bisecting the plate (201) and 0.6875 inches from. the top or bottom edge of the plate (201), respectively.

The two remaining holes (402) are used to secure the hydraulic unit (208) to the cylinder plate (202). As shown in FIG. 2, screws with lockwashers (207) pass through the hydraulic unit (208) and into the holes (402) to secure the hydraulic unit (208) to the cylinder plate (202). In the preferred embodiment of FIG. 4, these holes (402) are centered 0.072 inches from a center line bisecting the plate (202) and 1.1 inches from an upper edge of the plate (202).

FIG. 5 similarly illustrates a preferred embodiment of the back plate (201) of the present invention. Like the cylinder plate, the back plate (201) is preferably a square measuring 4.375 inches to a side. Four holes (500) are located at the corners of the plate (201) to receive the threaded ends of the four bolts (204) that connect the cylinder (202) and back (201) plates. These holes (500) are preferably located identically with respect to the back plate (201) as the holes (401) described above are located with respect to the cylinder plate (202).

Additionally, the back plate (201) includes a fifth hole (203) through which the interference-fit connecting pin (102) passes when ejected from the chain (100) by the hydraulic cylinder or head (211). As described above, the connecting pin (102) is not located along a center line of the chain plates (101), but is offset downward slightly to allow the rollers (103) on the pins (102) to extend below the chain plates (101). Consequently, the hole (203) through which the ejected connecting pin (102) passes is not located precisely in the center of the back plate (201). Rather, the hole (203) is preferably centered 1.9375 inches from an upper edge of the back plate (201), but is centered with respect to the left and right sides of the plate (201) as shown in FIG. 5.

Returning to FIG. 2, when the chain (100) is placed in the press (200) of the present invention, the nuts (205) on the bolts (204) can be tightened to secure the chain (100) in the press (200). As shown in FIG. 2, the back plate (201) abuts an outer plate (101D) of the chain (100). However, the back plate (201) also extends beyond the outer plate (101D) to the left as shown in FIG. 2.

Figure 6:
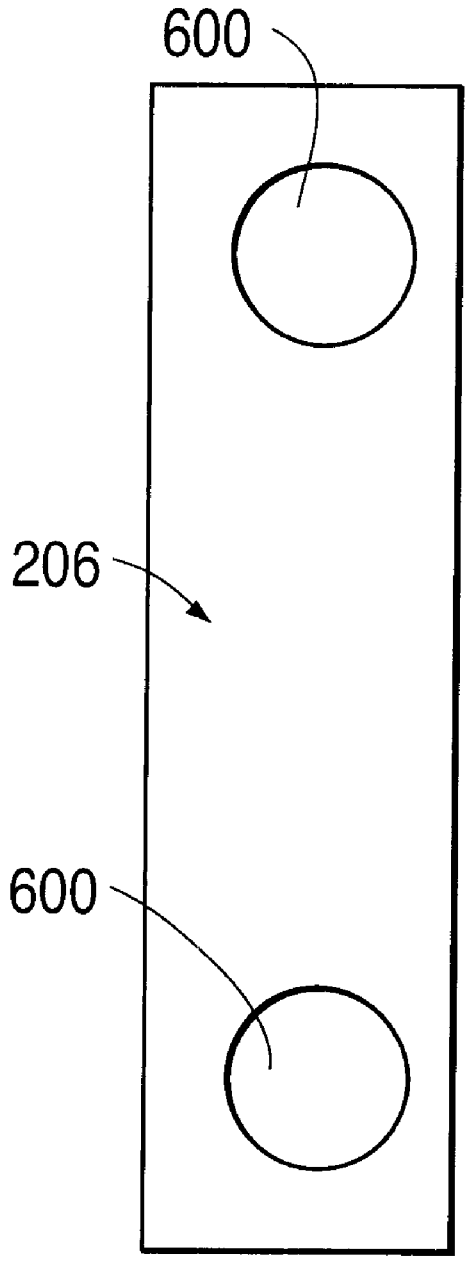
FIG. 6 is an illustration of a spacer plate of the press of FIG. 2.

Consequently, a spacer plate (206) is provided between the adjacent inner plate (101E) and the back plate (201) to allow the back plate (201) to be evenly forced against the inner (101E) and outer (101D) plates of the chain (100) when the nuts (205) are tightened. FIG. 6 illustrates a preferred embodiment of the spacer plate (206) in detail.

As shown in FIG. 6, the spacer plate (204) preferably has a length equal to a side of the back plate, e.g. 4.375 inches. The preferred spacer plate (204) shown in, FIG. 6 has a width of 1.1875 inches.

Two holes (600) are provided in the spacer plate (206) to allow the bolts (204) to pass through the spacer plate (206) and then through the back plate (201), as shown in FIG. 2. These holes (600) correspond in size and positioning to the holes (500) in the back plate.

After the chain (100) has been broken or disassembled using the present invention as described above, appropriate maintenance or repairs can be undertaken. However, it will then be necessary to reassemble the. chain (100) to restore the system to operation.

As will be appreciated by those skilled in the art, the press (200) of the present invention can be used to reassemble the chain, or for initial assembly of the chain, in a manner similar to that described above. For example, in an assembly operation, the hydraulic head (211) can be used to drive the linking pin (102) into interference fit in the plates (101) of the chain (100), just as it is used to push the pin (102) out for disassembly.

The bolts (204) between the plates (201,201, 201) may need to be lengthened to accommodate the width of the chain, the length of the pin (102) and the height of the hydraulic cylinder (208). The pin is aligned with the holes in the plates (101) of the chain. The hydraulic head (211) is abutted against the head of the pin (102), and the hydraulic cylinder (208) is actuated to drive the pin (102) into the plates (101) of the chain in an interference fit. The cotter pin (104) can then be installed.

The preceding description has been presented only to illustrate and describe the invention. It is not intended to be exhaustive or to limit the invention to any precise form disclosed. Many modifications and variations are possible in light of the above teaching.

For example, the size of the back, cylinder and spacer plates described above, as well as the size and positioning of the holes in the plates can be modified to accommodate various sizes of conveyor chains that need be disassembled or reassembled by removing or inserting interference-fit connecting pins. The length of the bolts (204) can also be varied to accommodate pins (102) of different sizes. Additionally, an adapter may be placed over the hydraulic-cylinder or head (211) that will allow the pressure to be applied to a smaller area to, for example, push the pin (102) further through the chain (100).

The preferred embodiment described above is specific to a conveyor chain used in cathode ray tube manufacture to process the tubes through a frit sealing oven. The preferred embodiment does not limit the scope of the invention but was chosen and described to explain the principles of the invention and its practical application. The preceding description is intended to enable others skilled in the art to best utilize the invention in various embodiments and with various modifications as ate suited to the particular use contemplated. It is intended that the scope of the invention be defined by the following claims.

What is claimed is:

1. A hydraulic press for disassembling or assembling a conveyor chain with interference-fit connecting pins between chain links, the press comprising a hydraulic unit with a hydraulic head and a structure for clamping said hydraulic unit to said conveyor chain such that said hydraulic head, when actuated, forces one of said interference-fit connecting pins at least partially out of said conveyor chain to disassemble said conveyor chain, the structure comprising a back plate, a cylinder plate on which said hydraulic unit is mounted, and a plurality of bolts connecting said back plate to said cylinder plate;

wherein said structure is clamped to said conveyor chain by tightening said plurality of bolts between said back plate and said cylinder plate when said chain is disposed between said back plate and said cylinder plate.

2. The press of claim 1, further comprising a spacer plate in contact with said back plate and an inner plate of a first chain link of said conveyor chain such that said back plate rests evenly on an outer plate of a second chain link adjacent said first chain link and said spacer plate.

3. The press of claim 1, wherein said back plate comprises a hole through which said connecting pin passes when forced from said chain by said hydraulic head.

4. The press of claim 3, wherein said hole is offset from a center of said back plate.

5. A method of disassembling a conveyor chain wit interference-fit connecting pins between chain links, the method comprising clamping a portable hydraulic unit with a hydraulic head to said conveyor chain such that said hydraulic head, when actuated, forces one of said interference-fit connecting pins at least partially out of said conveyor chain to disassemble said conveyor chain, said clamping further comprising placing said conveyor chain between a back plate and a cylinder plate on which said hydraulic unit is mounted; and said clamping further comprising tightening a plurality of bolts connecting said back plate to said cylinder plate.

6. The method of claim 5, further comprising placing a spacer plate in contact with said back plate and an inner plate of a first chain link of said conveyor chain such that said back plate rests evenly on an outer plate of a second chain link adjacent said first chain link and said spacer plate.

7. The method of claim 5, further comprising forcing said connecting pin through a hole in said back plate with said hydraulic head.

8. The method of claim 7, further comprising offsetting said hole from a center of said back plate to account for an offset of said connecting pin relative to a center line of said conveyor chain.

9. A hydraulic press for assembling or disassembling a conveyor chain with interference-fit connecting pins between chain links, the press comprising a hydraulic unit with a hydraulic head and means for clamping said hydraulic unit to said conveyor chain such that said hydraulic head, when actuated, forces one of said interference-fit connecting pins at least partially out of said conveyor chain to disassemble said conveyor chain, said means for clamping comprising a back plate, a cylinder plate on which said hydraulic unit is mounted, and means for connecting said back plate to said cylinder plate, said means for connecting said back plate to said cylinder plate comprising a plurality of bolts between said back plate and said cylinder plate which are tightened to clamp said hydraulic unit to said chain.

10. The press of claim 9, further comprising a spacer means in contact with said back plate and an inner plate of first chain link of said conveyor chain such that said back plate rests evenly on an outer plate of a second chain link adjacent said first chain link and said spacer means.

11. The press of claim 9, wherein said back plate comprises a hole through which said connecting pin passes when forced from said chain by said hydraulic head.

12. The press of claim 11, wherein said hole is offset from a center of said back plate.

13. A method of assembling a conveyor chain with interference-fit connecting pins between chain links, the method comprising clamping a portable hydraulic unit with a hydraulic head to said conveyor chain such that said hydraulic head, when actuated, forces one of said connecting pins into interference-fit between adjacent links of said chain to assemble said conveyor chain, said clamping further comprising placing said conveyor chain between a back plate and a cylinder plate on which said hydraulic unit is mounted, said clamping further comprising tightening a plurality of bolts connecting said back plate to said cylinder plate.

14. The method of claim 13, further comprising placing a spacer plate in contact with said back plate and an inner plate of a first chain link of said, conveyor chain such that said back plate rests evenly on an outer plate of a second chain link adjacent said first chain link and said spacer plate.

15. A hydraulic press with a hydraulic head for assembling or disassembling a conveyor chain with interference-fit connecting pins between chain links comprising:

a back plate, and a cylinder plate adjustably mounted in an axial direction with respect to the back plate defining a chain-receiving space therebetween, the cylinder plate having an inner surface, the hydraulic press mounted to the inner surface of the cylinder plate so that the hydraulic press is wholly self-contained within the chain-receiving space and adapted to be clamped to the chain by axially moving said back plate toward said cylinder plate when said chain is disposed within the chain-receiving space between said back plate and said cylinder plate.

16. The hydraulic press of claim 15, further comprising a spacer plate in contact with said back plate and an inner plate of a first chain link of said conveyor chain such that said back plate rests evenly on an outer plate of a second chain link adjacent said first chain link and said spacer plate.

17. The hydraulic press of claim 15, wherein said back plate comprises a hole through which said connecting pin passes when forced from said chain by said hydraulic head.

18. The hydraulic press of claim 17, wherein said hole is offset from a center of said back plate.

19. A hydraulic press for assembling or disassembling a conveyor chain, the conveyor chain having interconnected alternating first links and second links, each first link comprising a pair of parallel spaced inner plates and each second link comprising a pair of parallel spaced outer plates, each inner plate and outer plate having an outer surface, the outer surface of each outer plate being offset a distance from the outer surface of each inner plate to define an offset depth, with interference-fit connecting pins between chain links, the hydraulic press comprising a hydraulic head, a back plate, a cylinder plate adjustably mounted in an axial direction with respect to the back plate, the cylinder plate and back plate defining a chain-receiving space therebetween, the cylinder plate having an inner surface, and a spacer plate having a thickness generally equal to tie offset depth such that placement of the spacer plate in contact with the outer surface of the inner plate provides a generally planar bearing surface for communicating with the back plate defined by the spacer plate and the adjacent outer surface of the outer plate, and further having spaced openings for receiving connectors mounting the back plate to the cylinder plate to retain the spacer plate within the chain-receiving space.

20. The hydraulic press of claim 19, wherein said back plate comprises a hole through which said connecting pin passes when forced from said chain by said hydraulic head.

21. The hydraulic press of claim 20, wherein said hole is offset from a center of said back plate.

* * * * *